US005764129A

United States Patent [19]

Syouji et al.

[11] Patent Number: 5,764,129

[45] Date of Patent: Jun. 9, 1998

[54] CERAMIC RESISTOR, PRODUCTION METHOD THEREOF, NEUTRAL GROUNDING RESISTOR AND CIRCUIT BREAKER

[75] Inventors: Moritaka Syouji; Tadashi Kitami, both of Hitachi; Seiichi Yamada, Jouuou-machi; Ken Takahashi, Tokai-mura; Shingo Shirakawa, Hitachi; Takeo Yamazaki, Hitachi; Shigeru Tanaka, Hitachi; Shigehisa Motowaki, Hitachi, all of Japan

[73] Assignee: Hitachi, Ltd., Tokyo, Japan

[21] Appl. No.: 622,468

[22] Filed: Mar. 25, 1996

[30] Foreign Application Priority Data

Mar. 27, 1995 [JP] Japan ..... 7-067824

[51] Int. Cl.[6] ..... H01C 7/10

[52] U.S. Cl. ..... 338/22 SD; 338/20; 338/21; 338/204; 338/22 R

[58] Field of Search ..... 338/20, 21, 22 R, 338/22 SD, 52, 204, 205

[56] References Cited

U.S. PATENT DOCUMENTS

| | | | |
|---|---|---|---|
| 1,509,493 | 2/1924 | Slepian | 313/311 |
| 2,892,988 | 6/1959 | Schlusterius et al. | 338/9 |
| 2,933,586 | 4/1960 | Schusterius | 219/505 |
| 3,227,983 | 1/1966 | Braun | 338/21 |
| 4,041,436 | 8/1977 | Kouchich et al. | 338/21 |
| 4,527,146 | 7/1985 | Kanai et al. | 338/20 |
| 4,551,268 | 11/1985 | Eda et al. | 252/519 |

FOREIGN PATENT DOCUMENTS

| | | | |
|---|---|---|---|
| 507517 | 10/1992 | European Pat. Off. | 338/22 R |
| 56-4206 | 1/1981 | Japan . | |
| 63-55904 | 3/1988 | Japan . | |
| 4-64201 | 2/1992 | Japan . | |
| 5-41302 | 2/1993 | Japan . | |
| 5-101907 | 4/1993 | Japan . | |
| 6-168802 | 6/1994 | Japan . | |

OTHER PUBLICATIONS

English Tranlation of JP 6-168802, Tanaka et al.

*Primary Examiner*—Teresa J. Walberg
*Assistant Examiner*—Karl Easthom
*Attorney, Agent, or Firm*—Fay, Sharpe, Beall, Fagan, Minnich & McKee

[57] ABSTRACT

A ceramic resistor includes zinc oxide as a main component, and as essential components, aluminum oxide 3.0–40 mol %, magnesium oxide 2.0–40 mol %, silicon oxide 0.1–10 mol %, and at least one kind of compound 0.005–0.5 mol %, selected from a group consisting of calcium oxide, strontium oxide and barium oxide, and has a positive temperature coefficient of resistance. A neutral grounding resistor and a gas circuit breaker, each using the above-mentioned ceramic resistors, are disclosed.

12 Claims, 6 Drawing Sheets

CERAMIC RESISTOR, PRODUCTION METHOD THEREOF, NEUTRAL GROUNDING RESISTOR AND CIRCUIT BREAKER

BACKGROUND OF THE INVENTION

The present invention relates to a ceramic resistor which is excellent in current withstand capability and used for an electric apparatus or device, particularly, a transformer or a circuit breaker.

Conventional resistors are carbon-based resistors as disclosed in JP A 56-4206, metallic boride-based resistors as disclosed in JP A 5-41302 and zinc oxide-based resistors as disclosed in JP A 63-55904.

The carbon-based resistors each have a structure which has carbon powders dispersed in matrix consisting of $Al_2O_3$. This resistor has a specific resistance of several hundred Ωcm.

The metallic boride-based resistors each have a sintered body consisting of metallic boride and non-reducing glass, and they are resistors provided with temperature characteristics, current-voltage characteristics and current withstand capability.

On the other hand, the zinc oxide-based resistors each are polycrystalline substance, including ZnO as a main component and $Al_2O_3$, MgO, $Y_2O_3$, $Sb_2O_3$, $SiO_2$, etc. The resistors have a specific resistance of 10–1000 Ωcm, and are used according to apparatus or devices to which the resistor is applied. In those resistors, raw material powders of at least two kinds of the above-mentioned oxides are mixed, granulated with organic binder added thereto, and then formed with a metal mould. Then, the formed body is sintered in an electric furnace, and then electrodes are provided, whereby a resistor is produced.

Of the zinc oxide-based resistors, a ZnO-$Al_2O_3$-MgO-$SiO_2$ resistor is suitable for electric apparatus and devices such as transformers, circuit breakers. This kind of resistors are produced through mixing of powders, granulation, molding by a metal mould, sintering, and mounting of electrodes. The resistor disclosed in JP A 4-64201 has borosilicate glass added to ternal components of ZnO-$Al_2O_3$-MgO to reduce variation of resistance value. A resistor disclosed in JP A 6-168802 has CaO of 1–10 mol % (0.6–6 wt %) added to ternal components of ZnO-$Al_2O_3$-MgO to increase resistance value at which high voltage is applied.

A circuit breaker for electric power is disclosed in JP A 5-101907 in which a resistor is incorporated which uses a sintered body including zinc oxide as main component and titanium oxide and nickel oxide as auxiliary or accessory component.

A resistor for electric power is broken by force of thermal strain caused by thermal expansion accompanied with rapid heat generation of the resistor in which a lot of energy of current is poured at an operation time at which current flows. The conventional zinc oxide-based resistor has current withstand capability raised so as not to be broken. However, it is insufficient.

SUMMARY OF THE INVENTION

An object of the present invention is to provide a ceramic resistor which is excellent in current withstand capability and a production method of the ceramic resistor.

In order to achieve the above-mentioned object, a ceramic resistor according to the present invention includes zinc oxide (ZnO) as main component; and, as essential components, aluminum oxide ($Al_2O_3$) 3.0–40 mol %, magnesium oxide (MgO) 2.0–40 mol %, silicon oxide ($SiO_2$) 0.1–10 mol %, at least one kind of compound selected from a group consisting of calcium oxide (CaO), strontium oxide (SrO) and barium oxide (BaO) 0.005–0.5 mol %, and it is characterized in that the ceramic resistor has a positive (+) temperature coefficient of resistance.

Further, another ceramic resistor according to the present invention comprises 4 kinds of compounds of zinc oxide as a main component, aluminum oxide, magnesium oxide and silicon oxide 97.0–99.97 wt % in total, and additive of borosilicate glass including at least one kind of CaO/SrO/BaO 0.03–0.3 Wt %, the 4 kinds of compounds being aluminum oxide 3.0–40 mol %, magnesium oxide 2.0–40 mol %, silicon oxide 0.1–10 mol % and zinc oxide the remaining, the additive being at least one kind of CaO/SrO/BaO 1.0–40.0 wt % and borosilicate glass the remaining, and the at least one kind of CaO/SrO/BaO is included 0.003–0.3 Wt % to the total contents of the ceramic resistor and the temperature coefficient of resistance is positive.

In order to achieve the above-mentioned object, a production method of a ceramic resistor according to the present invention is characterized by, so as to form the above-mentioned further ceramic resistor, mixing respective oxide powders of zinc, aluminum, magnesium and silicon, and borosilicate flit glass including at least one kind of respective oxides of calcium, strontium and barium, molding it in a plate shape or columnar shape, sintering it to form a resistor body, and forming electrode films on both plate sides or both column end faces of the resistor body.

The present inventors have found that addition of a little amount of CaO, SrO, BaO to a ZnO-$Al_2O_3$-MgO-$SiO_2$ resistor improved remarkably the current withstand capability. Additionally, they found that the effect increased further when the additive of CaO, SrO, BaO was used, added to borosilicate glass. Even if 2 or 3 kinds of these additive CaO, SrO, BaO are added, the effect is not damaged. As for the borosilicate glass, the current withstand capability increases when borosilicate flit glass containing CaO, SrO, BaO (at least one kind of those oxides) of 1.0–40 wt % is added so that the borosilicate flit glass is 0.03–3.0 wt % to the whole ceramic resistor (sintered body) and CaO, SrO, BaO (at least one kind of those oxides) contained in the borosilicate flit glass is 0.003–0.3 wt % to the whole ceramic resistor (sintered body).

FIG. 1 is a front view of a columnar zinc oxide-based resistor according to the present invention. The resistor comprises a zinc oxide-based sintered body 1 and aluminum electrodes 2 formed on both ends of the zinc oxide-based sintered body 1. FIG. 2 is a front view of a doughnut type zinc oxide-based resistor according to the present invention. The resistor comprises a zinc oxide sintered body 3, aluminum electrodes 4 formed on both end surfaces of the sintered body 3 and a portion forming a hole 5 at the center of the resistor, the hole passing through the sintered body 3 and the electrodes 4 from one end to another end.

Further, the present invention is made on a neutral grounding resistor and a gas circuit breaker, using the ceramic resistor.

That is, the neutral grounding resistor comprises a tank containing a plurality of resistors laminated to provide a laminate, each resistor being a flat plate ceramic resistor having electrode films formed on both surfaces thereof according to the present invention; a terminal connected to one end of the laminate to dispose outside the tank; and a conductor of which one end is connected to the other end of the laminate and the other end is grounded.

Further, the gas circuit breaker comprises a closing resistor provided with a laminate formed by piling ceramic resistor plates, each having electrode films formed on both sides thereof according to the present invention, and a tank containing the closing resistor and an interrupting portion electrically connected to the closing resistor in parallel.

The neutral grounding resistor of a transformer is used for suppressing ground-fault current for a short time. In this current withstand capability test, AC current is flowed continuously in the resistor, whereby the time until thermorunaway takes place and energy are obtained. In this case, the resistor is always heated to a temperature of 200° C. or more, which causes damage.

FIG. 3 shows changes in current as time passes. A curve (6) is representative of a current change in the CaO-added resistor according to the present invention. A curve (7) is representative of a current change in the CaO-containing borosilicate flit glass-added resistor according to the present invention. A curve (8) is representative of a current change in a conventional resistor. The conventional resistor (8) comprises $Al_2O_3$ 15.0 mol %, MgO 5.0 mol %, $SiO_2$ 3.0 mol % and ZnO remaining. The ceramic resistor (6) according to the present invention has CaO 0.15 mol % added, and another ceramic resistor (7) according to the present invention has CaO 10 wt %-containing borosilicate glass 0.5 wt % added. The resistors are disc-shaped, each of which has diameter of 44 mm, thickness of 10 mm and electric resistance of 40 Ω. The resistors each have electrodes formed on both surfaces of the disc.

Initial current immediately after electric current starts to flow is 3.5 A, the electric current changes during the electric current passage. After the electric current decreases, the electric current increases for a while. At the maximum electric current 8 A in the ordinate, the temperature of the resistors reaches to several hundreds °C., and in a while thermorunaway takes place. In FIG. 3, a time until the electric current reaches 8 A is 52 sec in the CaO-added resistor (6) according to the present invention, 67 sec in the CaO-containing borosilicate glass-added resistor (7) according to the present invention, which time is longer than 40 sec in the conventional resistor (8) and 1.3 times and 1.7 times the time in the conventional resistor (8). It is found that the resistor according to the present invention is excellent in current withstand capability.

On the other hand, the resistor for circuit breaker has high voltage pulses applied during an interrupting operation, so that high voltage pulses are applied in the current withstand capability test according to this phenomenon. Current withstand capability of the resistors according to the present invention in FIG. 3 are better than that of the conventional resistor.

FIG. 4 shows changes in current passage time according to an amount of CaO. A curve 9 is of a resistor in which CaO 0–0.7 mol % is added to $Al_2O_3$ 10.0 mol %, MgO 7.0 mol %, $SiO_2$ 2.0 mol % and ZnO. On the other hand, a curve 10 is of a resistor in which CaO 10 wt % containing borosilicate glass 0–4.0 wt % is added to $Al_2O_3$-MgO-$SiO_2$-ZnO. In this case, an amount of CaO is plotted by mol %. The resistors each have diameter of 44 mm, thickness of 10 mm and electric resistance of 30 Ω. Initial current after current starts to flow is 3.2 A. In the resistor (9), current passage time is 58 sec when CaO is not added, 95 sec which is longest when CaO 0.2 mol % is added, and decreases to 61 sec when CaO 0.5 mol % is added. When CaO is added more, the time becomes shorter. Further, the passage time does not become longer when CaO is added 0.005 mol % or less. Therefore, an amount of CaO of the resistor represented by the curve (9) is suitable to be 0.005–0.5 mol %. On the other hand, in the resistor (10), passage time is 60 sec when CaO is not added, 98 sec which is longest when CaO 0.07 mol % (0.05 wt %) is added, and decreases to 59 sec when CaO 0.43 mol % (0.3 wt %) is added. When CaO is added more, the time becomes shorter. Further, the passage time does not become longer when CaO is added 0.0043 mol % (0.003 wt %) or less. Therefore, an amount of CaO of the resistor represented by the curve (10) is suitable to be 0.0043–0.43 mol %.

On the other hand, an amount of SrO and an amount of BaO are suitable to be the same amount as that of CaO, that is, 0.005–0.5 mol %. The current passage time becomes shorter outside this range.

The borosilicate glass used in the present invention comprises $SiO_2$ and $B_2O_3$ as main components, at least one kind of CaO, SrO and BaO as essential component, and optionally one kind or more of $Al_2O_3$, ZnO, MgO, $Na_2O$, $K_2O$, etc., CaO, SrO and BaO are added to the borosilicate glass by 1.0–40.0 wt %. An optimum range of borosilicate glass to be added is 0.03–3.0 wt %. Current passage is small outside the range.

When electric current flows in a ceramic resistor, the temperature of the ceramic resistor is raised to 300° C. or more. At this time, it is necessary not to cause thermorunaway by current increasing. ZnO-based resistors including $Al_2O_3$ 3–40.0 mol %, MgO 2.0–40 mol % and $SiO_2$ 0.1–10 mol % have a positive temperature coefficient of resistance. Observing temperature characteristics obtained by adding various kinds of flit glass to the ZnO-based resistors, it is found that there are resistors of positive temperature coefficient of resistance and resistors of negative temperature coefficient of resistance. Since it is found that the resistors according to the present invention belong to the former resistors, the current withstand capability can be improved.

Aluminum oxide ($Al_2O_3$) within the content range of the present invention reacts with zinc oxide (ZnO) to form complex compound crystal particles, whereby electric resistance is raised.

Magnesium oxide (MgO) raises electric resistance and converts the temperature coefficient of resistance into positive. Silicon oxide (SiO) improves sintering property.

On the other hand, calcium oxide (CaO), strontium oxide (SrO) and barium oxide (BaO) work as sintering assistance to make sintered body compact.

According to x-ray analysis, those oxides of sintering assistance promotes production reaction of complex compound crystal particles $ZnAl_2O_4$. As a result, thermal capacity increases, and the temperature coefficient of resistance increases, whereby the current withstand capability increases. The effects are increased further by using borosilicate glass having these 3 kinds of oxides added thereto. The borosilicate glass having those 3 kinds of oxides added thereto deposits between grains to work as sintering assistance and promotes growth of crystal particles of ZnO and $ZnAl_2O_4$.

DESCRIPTION OF EMBODIMENTS OF THE INVENTION

Embodiments of the present invention are explained hereunder.

EMBODIMENT 1

The following 3 kinds of powders are prepared:

(a) CaO 0.49 g (0.07 mol ratio), added to powder comprising ZnO 766.3 g (77.0 mol ratio), $Al_2O_3$ 187.1 g (15.0 mol ratio), MgO 24.6 g (5.0 mol ratio) and $SiO_2$ 22.0 g (3.0 ratio);

(b) Borosilicate glass containing CaO 10 wt % 5.0 g (0.5 wt %), added to the powder; and (c) Zinc borosilicate flit glass 5.0 g (0.5 wt %), added to the powder. The 3 kinds of powders each are mixed by a ball mill. A binder using polyvinyl alcohol is added to each of the three kinds of powders. The 3 kinds of powders are granulated by a granulator. The granulated powder is molded by a metal mould to form a disc shape of diameter 50 mm, thickness of 12 mm. The mould is sintered in an electric furnace at a temperature of 1050°–1300° C. for 4 hours. Finally, both sides of the sintered body are ground, aluminum is thermal sprayed on the both sides to form electrodes. In this manner, resistors each of which has diameter of 42–46 mm and thickness of 10 mm are formed. The resistors each have scale according to shrinkage.

Figure 5:
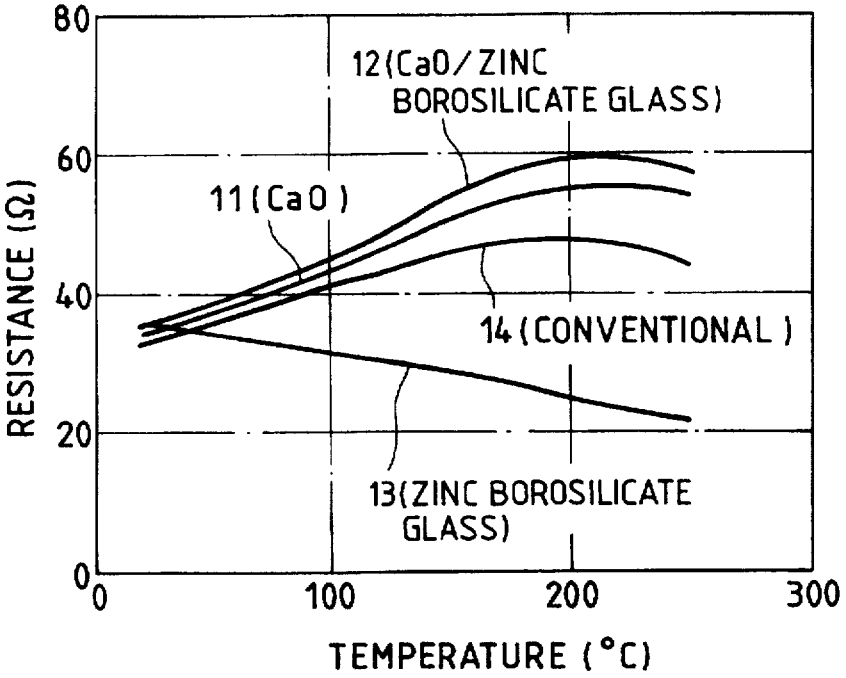
FIG. 5 is a diagram showing resistance temperature characteristics of each of a ceramic resistor added by CaO, a ceramic resistor added by CaO-containing borosilicate glass, etc.

FIG. 5 shows resistance temperature characteristics of three kinds of ceramic resistors formed in the above-mentioned manner. In FIG. 5, a curve 11 is of the resistor (a) having CaO added thereto, a curve 12 is of the resistor (b) having borosilicate flit glass containing CaO, a curve 13 is of the resistor (c) having zinc borosilicate flit glass added thereto, and a curve 14 is of a conventional ZnO-$Al_2O_3$(15 mol %)-MgO(5 mol %)-$SiO_2$(3 mol %)resistor. The conventional resistor has positive temperature coefficient. The temperature coefficient of resistance of the curve 14 between 20° C. and 200° C. is $+2.1\times10^{-3}$/°C. On the contrary, the temperature coefficient of resistance of the curve 11 of the resistor having CaO added thereto in the same temperature range as the above one is $+3.4\times10^{-3}$/°C., and the temperature coefficient of resistance of the curve 12 of the resistor having CaO-containing borosilicate glass added thereto in the same temperature range as the above one is further higher, that is, $+3.9\times10^{-3}$/°C. On the other hand, the temperature coefficient of resistance of the curve 13 of the resistor having zinc borosilicate glass added thereto in the same temperature range as the above one is $-1.6\times10^{-3}$/°C. which is negative in temperature coefficient of resistance. In this manner, the temperature coefficient of resistance differs according to the kinds of flit glass to be added. For example, the current withstand capability in AC passage of the resistor added by zinc borosilicate glass is drastically less than the above-mentioned three resistor having a positive temperature coefficient of resistance.

EMBODIMENT 2

The following 2 kinds of powders are prepared:

(d) $SrCO_3$ 1.93 g (equivalent to SrO 0.10 mol ratio), added to powder comprising ZnO 837 g (79.0 mol ratio), $Al_2O_3$ 66.4 g (5.0 mol ratio), MgO 63.0 g (12.0 mol ratio) and $SiO_2$ 31.2 g (4.0 mol ratio); and (e) $SrCO_3$ 10 wt %-containing borosilicate flit glass 5.0 g (0.5 wt %), added to the powder. Each of 2 kinds of the prepared powders (d) and (e) is mixed, and then resistors are formed in the same manner as in the embodiment 1. The temperature coefficient of resistance of the resistor made to contain SrO by addition of $SrCO_3$ is $+3.3\times10^{-3}$/°C., on the other hand, the temperature coefficient of resistance of the resistor made to contain SrO together with glass by addition of zinc borosilicate glass containing $SrCO_3$ is $+4.8\times10^{-3}$/°C., and the latter has a large temperature coefficient of resistance. These resistors each have a larger current withstand capability in AC passage than the conventional ZnO-$Al_2O_3$-MgO-$SiO_2$ resistor.

EMBODIMENT 3

The following 2 kinds of powders are prepared, one of them is: BaO 0.99 g (0.05 mol ratio), added to powder comprising ZnO 859 g (81.5 mol ratio), $Al_2O_3$ 66.0 g (5.0 mol ratio), MgO 62.6 g (12.0 mol ratio) and $SiO_2$ 11.6 g (1.5 mol ratio); and the other is: BaO 10 wt %-containing borosilicate flit glass 5.0 g (0.5 wt %), added to the powder. Each of the 2 kinds of powders is mixed, and then, resistors are formed in the same manner as in the embodiment 1. The temperature coefficient of resistance of the resistor having BaO added thereto is $+3.5\times10^{-3}$/°C., the resistance temperature coefficient of the resistor added by BaO-containing borosilicate flit glass is $+5.0\times10^{-3}$/°C., and a large temperature coefficient of resistance is obtained. These resistors each have a larger current withstand capability in AC passage than the conventional ZnO-$Al_2O_3$-MgO-$SiO_2$ resistor.

EMBODIMENT 4

Figure 6:
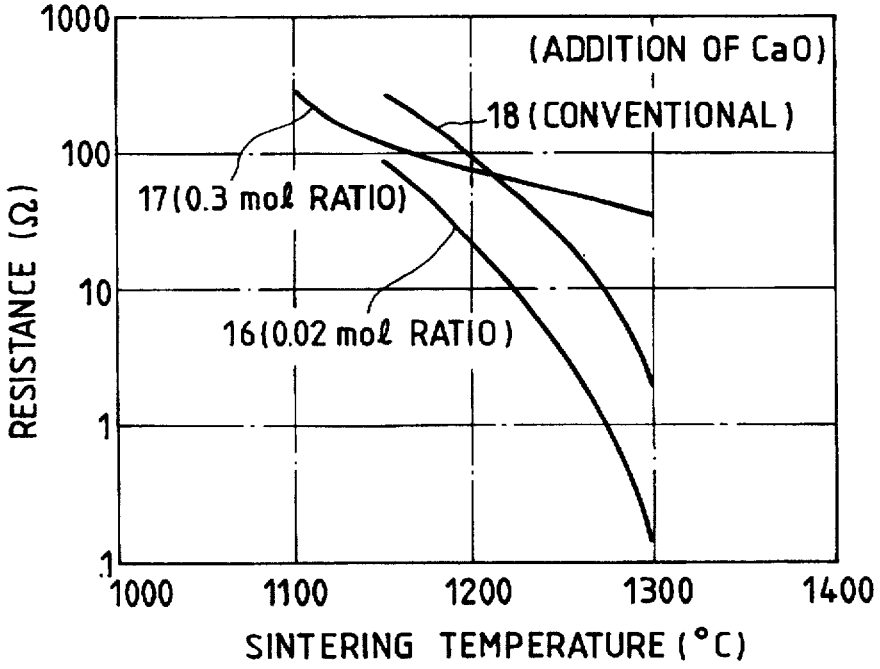
FIG. 6 is a diagram showing a change in electric resistance according to sintering temperature, of ceramic resistors added by CaO.

FIG. 6 shows a change in electric resistance of CaO-added ceramic resistors according to sintering temperature. A characteristic curve 16 is of a resistor in which CaO 0.02 by mol ratio is added to 79.5 ZnO-12.0 $Al_2O_3$-7.0 MgO-1.5 $SiO_2$ (by mol ratio), a characteristic curve 17 is of a resistor in which CaO 0.3 by mol ratio is added to the powder, and a characteristic curve 18 is of the conventional ZnO-$Al_2O_3$-MgO-$SiO_2$ resistor. The resistance value of a resistor used for a neutral grounding resistor is 25 to 40 Ω. The electric resistance of each characteristic curve decreases as sintering temperature increases. The resistor represented by the characteristic curve 16 is lower in sintering temperature by about 50° C. than the conventional resistor represented by the curve 18. On the other hand, in the resistor represented by the curve 17, a change in electric resistance according to sintering temperature is slow above 1150° C. This is because sintering behavior differs according to an amount of addition of CaO.

EMBODIMENT 5

Figure 7:
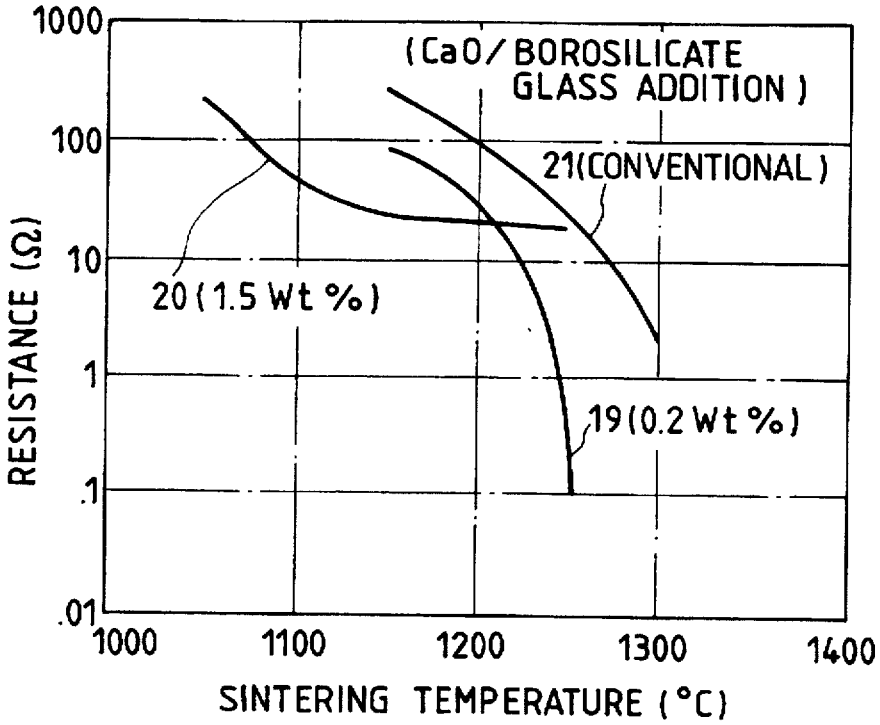
FIG. 7 is a diagram showing a change in electric resistance according to sintering temperature, of each of resistors added by CaO-containing borosilicate flit glass.

FIG. 7 shows changes in electric resistance of ceramic resistors added by CaO-containing borosilicate flit glass according to sintering temperature. A characteristic curve 19 is a resistor in which CaO 15 wt %-containing borosilicate flit glass of 0.2 wt % to the whole is added to 79.5 ZnO-12.0 $Al_2O_3$-7.0 MgO-1.5 $SiO_2$ (by mol ratio). A curve 20 is of a resistor in which the same flit glass as in the curve 19 is added by 1.5 wt %. A curve 21 is of the conventional ZnO-$Al_2O_3$-MgO-$SiO_2$ resistor. In the resistor represented by the curve 19, the change in electric resistance is sharper than the conventional resistor represented by the curve 21, on the contrary, the curve 20 is gentle. The resistor of the curve 19 is difficult to effect temperature adjustment of an electric furnace, on the contrary, the resistor of the curve 20 is easy to do it. This is because sintering differs according to an amount of addition of flit glass. The change amount in electric resistance according to sintering temperature influences on a yield rate in mass production. Resistors having large variation in resistance and resistors having small variation are produced according to an amount of addition of CaO-containing borosilicate flit glass.

EMBODIMENT 6

A resistor in which CaO 0–0.7 by mol ratio is added to ZnO-10.0 $Al_2O_3$-7.0 MgO-2.0 $SiO_2$ (by mol ratio), and a resistor in which CaO 10 wt %-containing borosilicate glass 0–4.0 wt % is added to ZnO-10.0 $Al_2O_3$-7.0 MgO-2.0 $SiO_2$ (by mol ratio), are produced, respectively. The electric resistance is 30 Ω.

Figure 8:
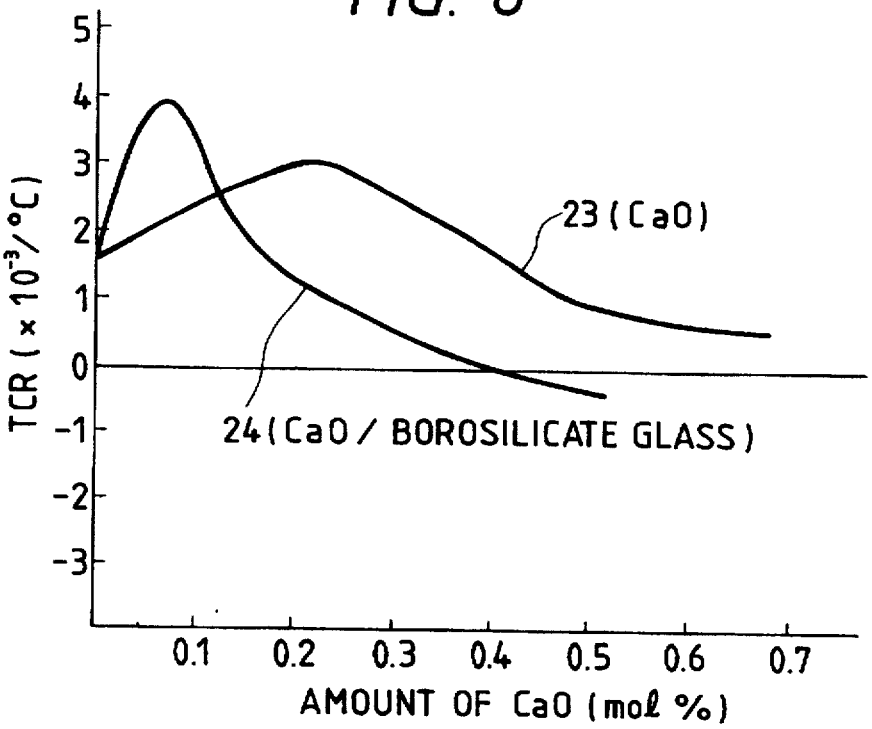
FIG. 8 is a diagram showing a change in temperature coefficient of resistance according to an amount of CaO, of each of a ceramic resistor added by CaO and a ceramic resistor added by CaO-containing borosilicate glass.

FIG. 8 shows change in temperature coefficient of resistance according to an amount of CaO. A characteristic curve 23 is of a resistor added by CaO, on the other hand, a characteristic curve 24 is of a resistor added by CaO-containing borosilicate glass. The amount of CaO is plotted by mol %. Initial current immediately after current passage is 3.2 A. The temperature coefficient of resistance represented by the curve 23 is highest at 0.22 mol % of CaO, and the temperature coefficient of resistance represented by the curve 24 is highest at 0.07 mol % of CaO. In the curve 23, the temperature coefficient of resistance is $1.6\times10^{-3}$/°C. without addition of CaO, while it is maximum, $3.0\times10^{-3}$/°C., at addition of CaO 0.22 mol %. The temperature coefficient of resistance decreases when CaO is added more than 0.22 mol %, however, even when CaO of 0.5 mol % is added, the temperature coefficient of resistance is $1.0\times10^{-3}$/°C., and it does not become negative. On the other hand, in the curve 24, when CaO of 0.007 mol % (borosilicate glass 0.5 wt %) is added, the temperature coefficient of resistance becomes maximum, $4.0\times10^{-3}$/°C., and it decreases upon further addition of CaO. Further, the temperature coefficient of resistance is converted into negative value at addition of CaO 0.43 mol % (borosilicate glass 3.0 wt %).

It is noted from the results of FIG. 5 and FIG. 8 flit glass for raising positive temperature coefficient of resistance is limited in its kind and its amount.

EMBODIMENT 7

Figure 1:
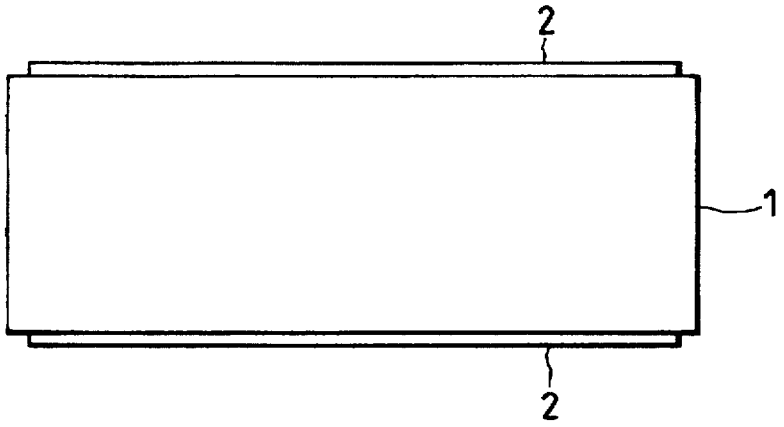
FIG. 1 is a front view of columnar zinc oxide-based resistor according to the present invention.
Figure 2:
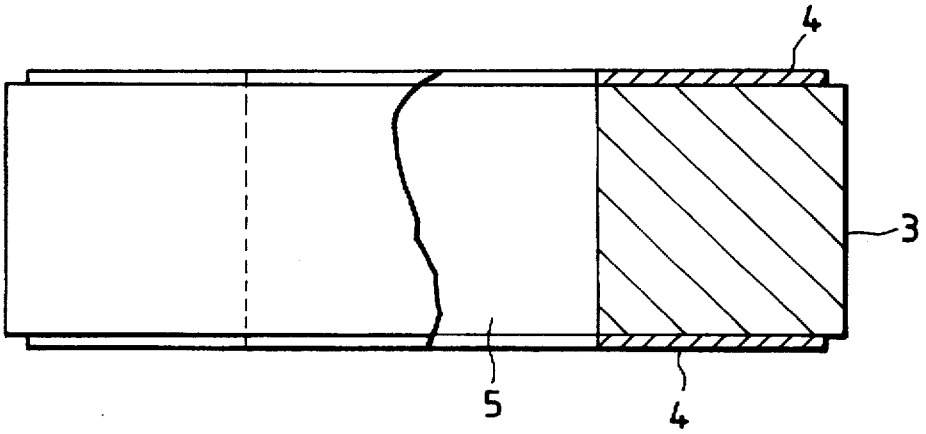
FIG. 2 is a partial sectional front view of a doughnut type zinc oxide-based resistor according to the present invention.
Figure 3:
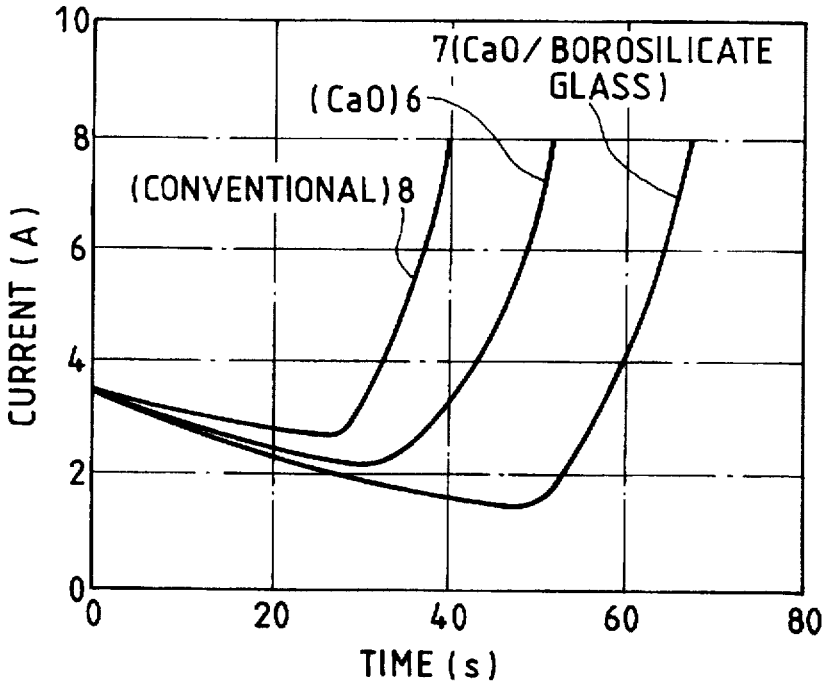
FIG. 3 is a diagram showing a change in electric current according to electric current passage time, of each of a ceramic resistor added by CaO, a ceramic resistor added by CaO-containing borosilicate glass, etc.
Figure 4:
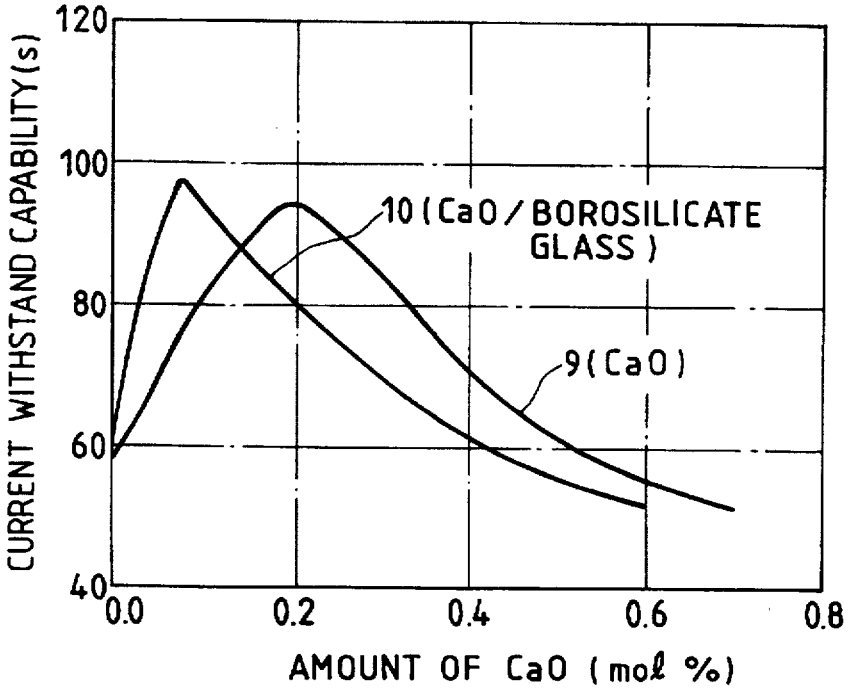
FIG. 4 is a diagram showing a change in current withstand capability according to an amount of CaO, of each of a ceramic resistor added by CaO and a ceramic resistor added by CaO-containing borosilicate glass.
Figure 9:
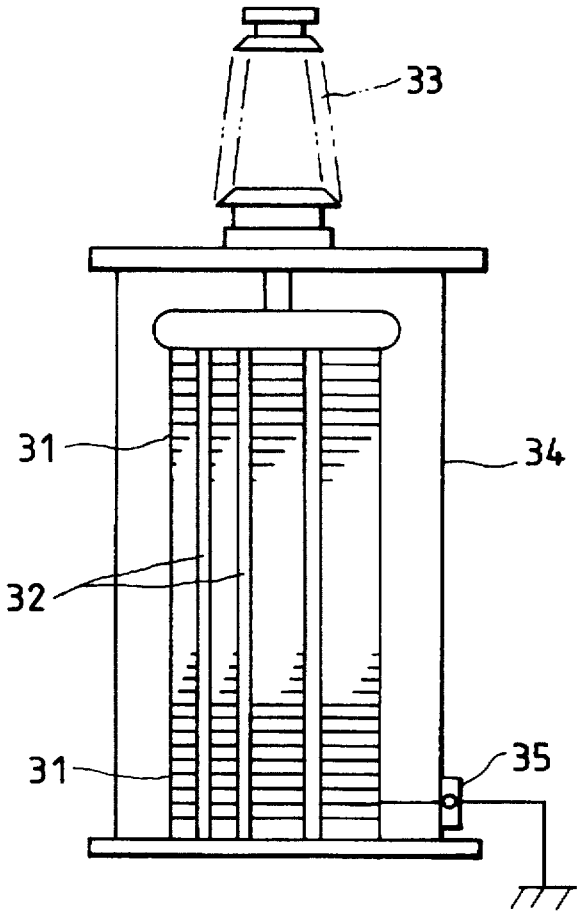
FIG. 9 is a sectional view of a neutral grounding resistor using a ceramic resistor according to the present invention.

FIG. 9 shows an example of application of the doughnut type ceramic resistor shown in FIG. 2 to a neutral grounding resistor of a transformer. The neutral grounding resistor employs a large scaled resistor of specific resistance 450 Ωcm which is produced using the powders, added by CaO-containing borosilicate flit glass, produced in the process of the embodiment I.

In FIG. 9, number 31 denote resistor elements, number 32 insulating rods, number 33 a bushing, number 34 a tank and number 35 a grounding point. A plurality of the resistor elements 31 are piled up in the tank 34 to form a laminate, and they are electrically connected in series. The resistor elements each have a throughhole formed therein, and they are fixed to the interior of the tank 34 by the insulating rods 32 passing through the throughholes thereof. The bushing 33 provided on the upper surface of the tank 34 is connected to a bushing for neutral point of an adjacent transformer by electric wires, and further connected to one end of the laminate of the resistor elements 31 in the tank 34. The other end of the laminate of the resistor elements 31 is electrically connected to earth by a conductive wire. The transformer is protected by suppressing ground-fault current generated when ground fault occurs in one line of power transmission lines of the neutral grounding resistor to about 100–300 A and interrupting the closed circuit within 10–15 sec by a circuit breaker.

Since a neutral grounding resistor using resistor elements each having outer diameter 100 mm and resistance 15 Ω has a high strength, the allowable temperature can be raised by 21% and the thermal capacity can be increased by 25%. Therefore, the resistance value can be increased by 25% of 17.8 Ω, as a result, the number of the resistor elements per one column can be reduced by 20%. While a conventional neutral grounding resistor uses 620 resistor elements in 10 rows, the present invention can provide the neutral grounding resistor of 496 resistor elements.

EMBODIMENT 8

Figure 10:
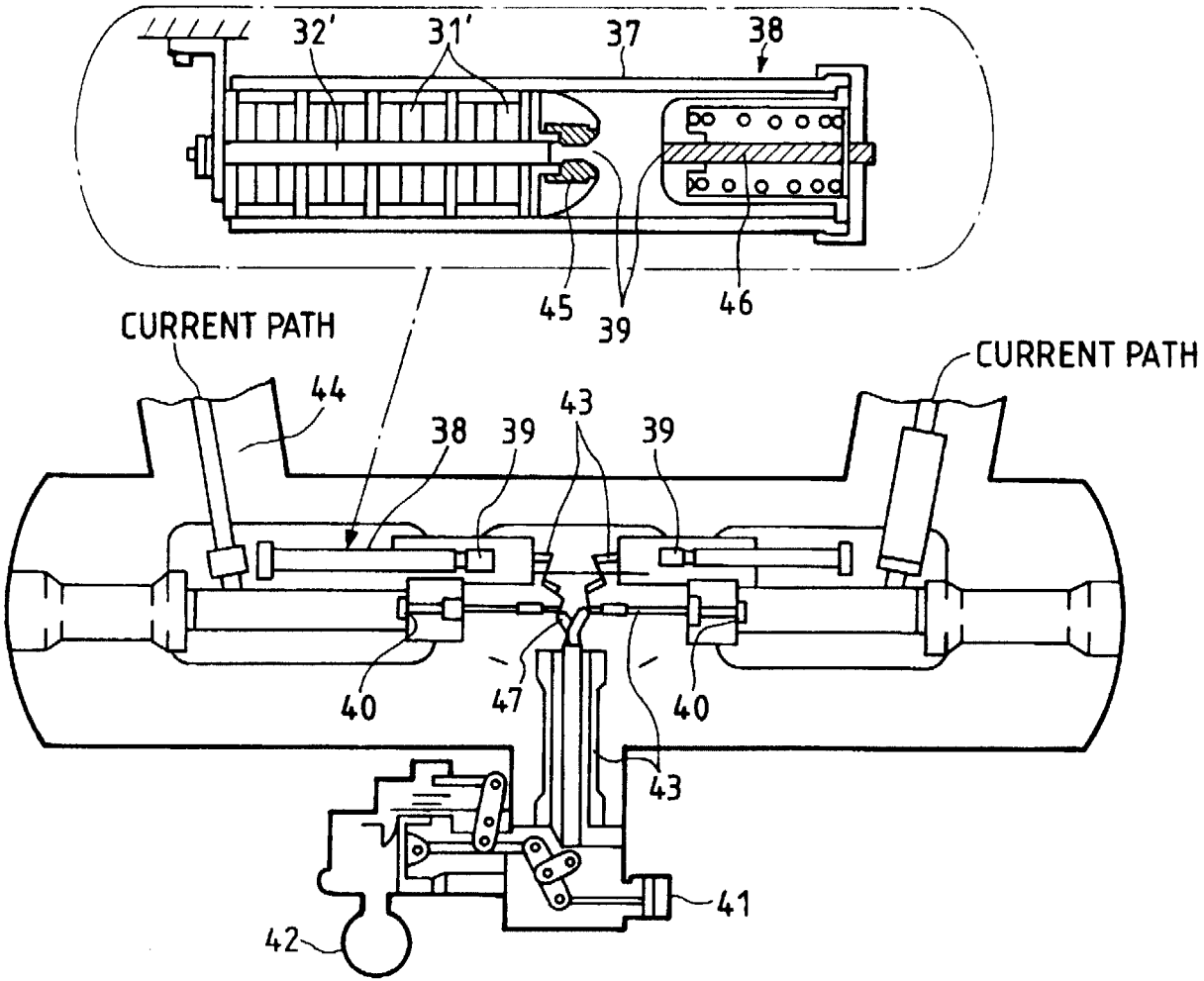
FIG. 10 is a sectional view of a closing resistor for gas circuit breaker, using a ceramic resistor according to the present invention.

FIG. 10 shows an example of an application of the doughnut type resistor shown in FIG. 2 for a closing resistor of a double-break puffer type gas circuit breaker. Here, a resistor of specific resistance 200 Ωcm is applied, using powders added by CaO 0.2 mol ratio, produced in the process in the embodiment 1. Reference number 31' denotes a resistor element, number 32' insulating rod, number 37 an insulating cylinder, number 38 resistor unit, number 39 resistive contact, number 40 main contact, number 41 piston, number 42 air tank, number 43 an insulating rod, number 44 bushing, number 45 fixed conductor, number 46 movable conductor and number 47 a mechanism unit. It is made so that interruption resistance is 500 Ω. The fixed conductor 45 is mounted on one side of the resistor element 31' to form the resistive contact 39. On the other hand, the tip of the movable conductor 46 is the resistive contact 39. The resistive contact 39 and the main contact 40 are opened or closed, through the insulating rod 43, by the piston 41 driven with air from the air tank 42 operated by an electromagnetic valve (not shown).

An interruption operation is as follows:

1) The main contacts 40 are opened, whereby current flows through the resistor unit 38, 2) the resistive contacts 39 are opened, whereby the interruption operation is finished.

On the other hand, a closing operation is as follows:

1) The resistive contacts 39 are closed, and current flows into the resistor unit 38, and 2) the main contacts 40 are closed, whereby the closing operation is finished. AC discharge current of several ten msec flows through the resistor elements 31' and overvoltage is absorbed, when the main contacts are opened.

According to the present invention, since the current withstand capability and the temperature characteristics are excellent, the number of the resistors used in the gas circuit breaker can be reduced, compared with a conventional one.

According to the present invention, since the ceramic resistor is constructed by 4 kinds of compounds of zinc oxide as main component, aluminum oxide, magnesium oxide and silicon oxide; and an additive comprising at least one kind of calcium oxide (CaO), strontium oxide (SrO) and barium oxide (BaO), and it has a positive temperature coefficient of resistance, the resistor has the effect that the current withstand capability can be raised by the at least one kind of CaO, SrO and BaO.

Further, according to the present invention, the ceramic resistor is constructed by the above-mentioned 4 kinds of compounds and borosilicate glass containing at least one kind of CaO, SrO and BaO, and it is made so as to be positive in temperature coefficient of resistance, so that the ceramic resistor has the effect that the effect of increasing the current withstand capability of the ceramic resistor by the at least one kind of CaO, SrO and BaO can be raised further by the borosilicate glass.

By using such a ceramic resistor of a high current withstand capability, the number of resistors used can be reduced, as compared with conventional resistors, the neutral grounding resistor and the gas circuit breaker closing resistor can be made small due to this reduction in the number of resistors.

What is claimed is:

1. A ceramic resistor, comprising zinc oxide as main component, and as essential components, aluminum oxide 3.0–40 mol %, magnesium oxide 2.0–40 mol %, silicon oxide 0.1–10 mol %, and at least one kind of compound from 0.005 to less then 0.5 mol %, selected from a group consisting of calcium oxide, strontium oxide and barium oxide.

2. A ceramic resistor according to claim 1, wherein said ceramic resistor has a positive temperature coefficient of resistance.

3. A neutral grounding resistor, comprising:

a tank containing therein a laminate of a plurality of resistors piled up each comprising a ceramic resistor as set forth in claim 2, being formed in a flat plate and electrode films mounted on both surfaces of said flat plate;

a terminal connected to one end of said laminate and disposed on an outer surface of said tank; and a conductive member one end of which is connected to other end of said laminate and the other end is connected to the earth.

4. A gas circuit breaker, comprising:

a closing resistor having a laminate of a plurality of resistors piled up each comprising a plate of ceramic resistor as set forth in claim 2, and electrode films formed on both surfaces of said plate;

an interruption part electrically connected to said closing resistor in parallel; and a tank for containing therein said closing resistor and said interruption part.

5. A ceramic resistor according to claim 2, wherein said at least one kind of compound has a content of 0.003–0.3% of the total contents of said ceramic resistor.

6. A neutral grounding resistor, comprising:

a tank containing therein a laminate of a plurality of resistors piled up each comprising a ceramic resistor as set forth in claim 1, being formed in a flat plate and electrode films mounted on both surfaces of said flat plate;

a terminal connected to one end of said laminate and disposed on an outer surface of said tank; and a conductive member one end of which is connected to other end of said laminate and the other end is connected to the earth.

7. A gas circuit breaker, comprising:

a closing resistor having a laminate of a plurality of resistors piled up each comprising a plate of ceramic resistor as set forth in claim 1, and electrode films formed on both surfaces of said plate;

an interruption part electrically connected to said closing resistor in parallel; and a tank for containing therein said closing resistor and said interruption part.

8. A neutral grounding resistor, comprising a tank containing a ceramic resistor according to claim 1.

9. A ceramic resistor, comprising:

4 kinds of compounds 97.0–99.97 wt % in total, composed of zinc oxide as a main component, aluminum oxide, magnesium oxide and silicon oxide, said 4 kinds of compounds being aluminum oxide 3.0–40 mol %, magnesium oxide 2.0–40 mol %, silicon oxide 0.1–10 mol % and zinc oxide the remaining, and an additive 0.03–3 wt %, said additive being borosilicate glass containing at least one kind of compound selected from a group consisting of calcium oxide, strontium oxide and barium oxide, said additive being said at least one kind of compound 1.0–40 wt % selected from said group and the borosilicate glass the remaining, said at least one kind of compound selected from said group being 0.003–0.3 wt % to the total contents of said ceramic resistor, and having a positive temperature coefficient of resistance.

10. A neutral grounding resistor, comprising:

a tank containing therein a laminate of a plurality of resistors piled up each comprising a ceramic resistor as set forth in claim 9, being formed in a flat plate and electrode films mounted on both surfaces of said flat plate;

a terminal connected to one end of said laminate and disposed on an outer surface of said tank; and a conductive member one end of which is connected to other end of said laminate and the other end is connected to the earth.

11. A gas circuit breaker, comprising:

a closing resistor having a laminate of a plurality of resistors piled up each comprising a plate of ceramic resistor as set forth in claim 9, and electrode films formed on both surfaces of said plate;

an interruption part electrically connected to said closing resistor in parallel; and a tank for containing therein said closing resistor and said interruption part.

12. A neutral grounding resistor, comprising a tank containing a ceramic resistor according to claim 9.

* * * * *